US006749494B2

(12) United States Patent
Mandall

(10) Patent No.: US 6,749,494 B2
(45) Date of Patent: Jun. 15, 2004

(54) CONDITIONING TOOL

(76) Inventor: Michael C. Mandall, 901 E. Madison St., Phoenix, AZ (US) 85034

( * ) Notice: Subject to any disclaimer, the term of this patent is extended or adjusted under 35 U.S.C. 154(b) by 217 days.

(21) Appl. No.: 09/829,896

(22) Filed: Apr. 11, 2001

(65) Prior Publication Data

US 2002/0151264 A1 Oct. 17, 2002

(51) Int. Cl.[7] ..... B24B 21/18

(52) U.S. Cl. ..... 451/444; 451/41; 451/56; 451/287; 451/290; 451/443

(58) Field of Search ..... 451/41, 56, 287, 451/290, 443, 444

(56) References Cited

U.S. PATENT DOCUMENTS 5,738,574 A * 4/1998 Tolles et al. ..... 451/288
6,293,853 B1 * 9/2001 Perlov et al. ..... 451/56

* cited by examiner

*Primary Examiner*—Joseph J. Hail, III
*Assistant Examiner*—Shantese McDonald
(74) *Attorney, Agent, or Firm*—Cahill, von Hellens & Glazer P.L.C.

(57) ABSTRACT

A tool for conditioning a wafer polishing pad includes a body having a recess in the upper surface thereof. A holder has a portion extending into the recess in the body. An elastomeric member between the holder and the body acts as a gimble permitting planar contact of the tool with the pad.

13 Claims, 2 Drawing Sheets

CONDITIONING TOOL

TECHNICAL FIELD

This invention is directed to improving the performance of a tool for conditioning a semiconductor polishing pad.

BACKGROUND ART

In the production of integrated circuits the wafer on which the circuits are constructed is subjected to repetitive chemical mechanical polishing, or planarization, steps. Polishing is performed on a resilient pad in conjunction with a chemical slurry.

The production of quality circuits is dependent in large measure on proper conditioning, or reconditioning, of the polishing pad. Conditioning of the pad, which can be done after a wafer has been polished (ex-situ) or as the wafer is being polished (in-situ), is essentially a roughening and flattening of the pad surface. Thus, the conditioning tool is a body having an abrasive surface which is pressed against and moved across the pad.

U.S. Pat. No. 5,842,912, granted Dec. 1, 1998 to Holzapfel et al. for "Apparatus for Conditioning Polishing Pads Utilizing Brazed Diamond Technology" discloses a pad conditioning apparatus. U.S. Pat. No. 5,954,570, granted Sep. 27, 1999 to Yano et al. for "Conditioner for a Polishing Tool", discloses a pad conditioning tool.

Both Holzapfel et al. and Yano et al. recognize that the conditioning tool should be mounted flexibly to permit the tool to have planar contact with the pad being polished. They include a ball and socket connection in the drive system above the tool. The pivot point of the ball and socket connection is a substantial distance above the abrasive surface of these tools so drag forces acting laterally across the tool surface act through a substantial moment arm tending to tilt the tool excessively and producing chatter, or vibration of the tool. The result can be uneven conditioning of the polishing pad.

There continues to be a need for a conditioning tool that is stable and reliable in operation.

SUMMARY OF THE INVENTION

This invention contemplates forming the conditioning tool with a body member having an abrasive peripheral lower surface and a central recess from the upper surface. A holder for the tool extends into the recess in the body member and an elastomeric member between the holder and the body member holds the latter two components together. There is clearance between the holder and the body member and the elastomeric member acts as a gimble and permits the body member to tilt with respect to the holder for planar contact with the surface of the pad being polished.

BRIEF DESCRIPTION OF THE DRAWINGS

The invention is described in greater detail hereinafter by reference to the accompanying drawings wherein:

FIG. 3A is an enlargement of that portion of FIG. 3 within circle 3A in FIG. 3.

DETAILED DESCRIPTION OF THE INVENTION

Figure 1:
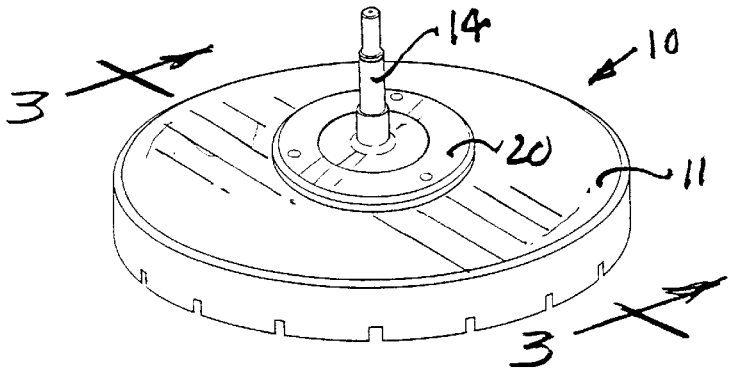
FIG. 1 is a perspective view of a conditioning tool embodying the invention.
Figure 2:
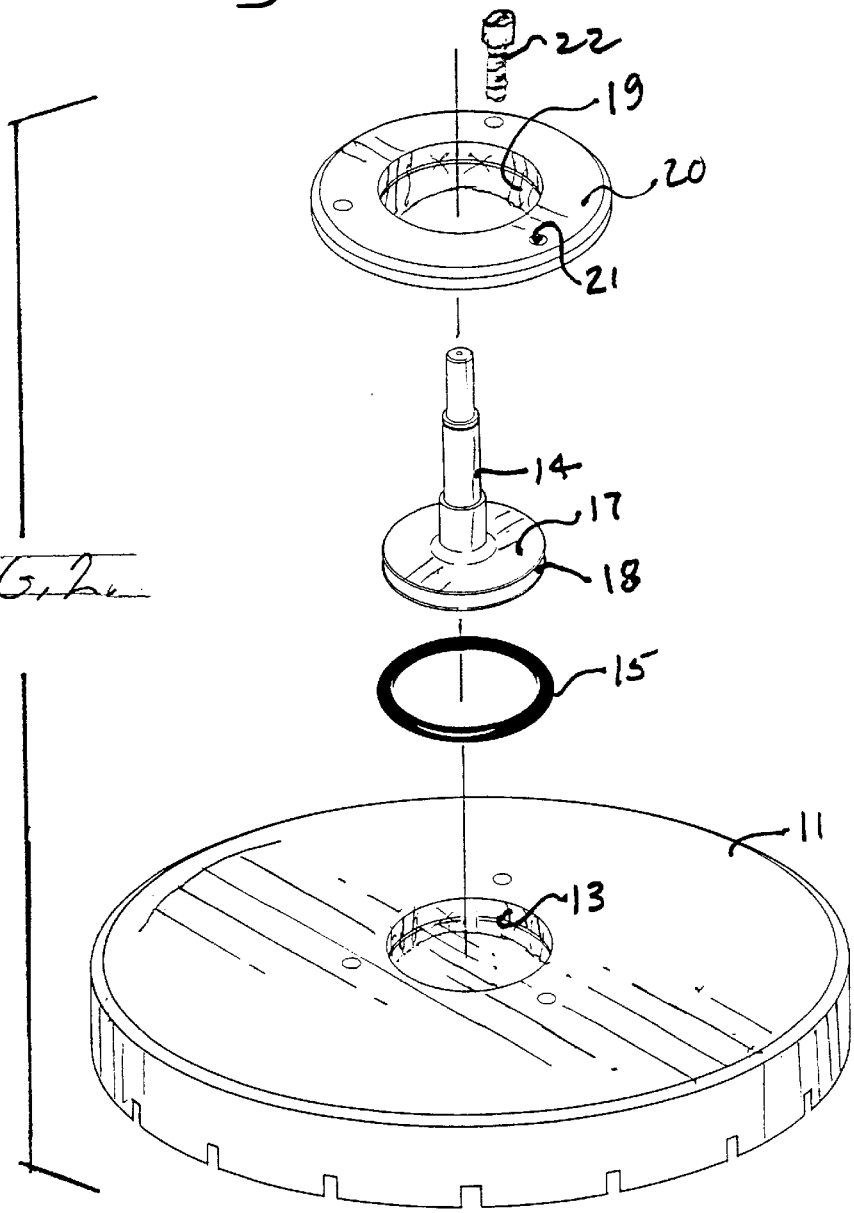
FIG. 2 is an exploded perspective view of the tool of FIG. 1.
Figure 3:
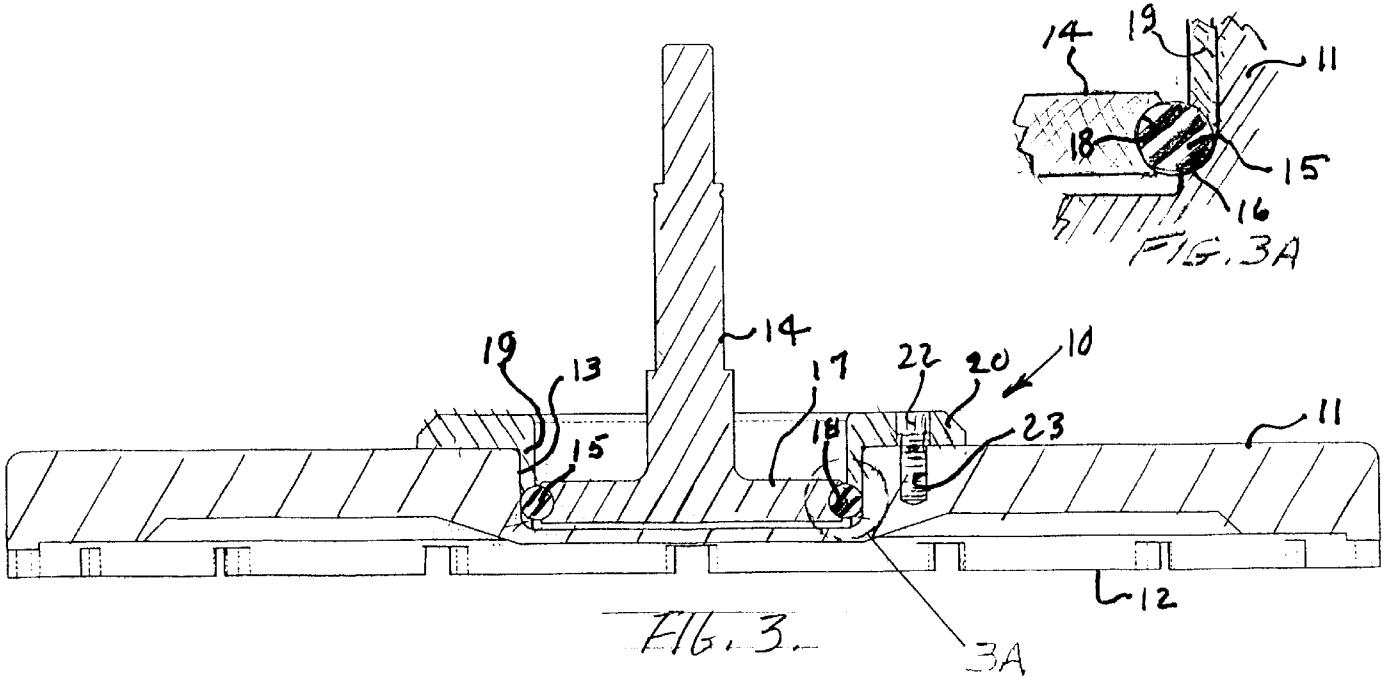
FIG. 3 is a vertical sectional view of the tool taken generally as indicated by line 3—3 in FIG. 1.

Referring to FIGS. 1 to 3 and 3A, the conditioning tool there illustrated is indicated generally by reference numeral 10. The tool comprises three principal components, namely, a body 11 having an abrasive peripheral lower surface 12 and a central recess 13 from its upper surface, a holder 14 extending down into the body recess 13, and a elastomeric member 15 between the holder 14 and the body 11.

The abrasive surface 12 may be provided on the body in a variety of ways depending upon the composition of the pad to be conditioned. One abrasive coating currently used for polishing urethane mats consists of diamond particles in a matrix of metal braze.

Elastomeric member 15 is preferably an O-ring having a circular cross-section and made from a chemically resistant synthetic rubber, such as Neoprene. Such rings are widely available commercially and can be obtained in selected degrees of hardness and flexibility.

The body 11 in the lower region of the recess 13 therein is shaped as indicated at 16 to conform to the surface configuration of the member 15 to embrace a lower portion of the member.

Similarly, the portion 17 of holder 14 which extends into the holder recess 13 has a concave periphery 18 shaped to conform to the surface configuration of the member 15.

The lower wall region of body 11 in recess 13 could be configured like the concave region 18 of the holder 14 so the holder with member 15 in place could be snapped into place in the body. However, for ease of assembly and disassembly, it is preferred that a cylindrical retainer 19 be employed to slide into the recess and engage an upper region of the member 15. Retainer 19 has a flange 20 at its upper end. A series of openings 21 through flange 20 permit a series of threaded bolts 22 to enter tapped bores 23 in the body 11 to secure the retainer 19 on the body 11.

The resilient connection provided by member 15 between the holder 14 and the body 11, which is sometimes referred to as a "gimble", is superior in several respects to prior gimbles for conditioning tools.

In the first place, the gimble connection of this invention is down in the body 11 only a short distance above the abrasive surface 12. Thus, the moment arm for drag forces acting on surface 12 is much lower than for the moment arm for similar forces acting on prior conditioning tools having the gimble connection well above the body of the tool. See, for example, the tools disclosed in the aforementioned Holzapfel et al. and Yano et al. patents. Furthermore, the elastomeric properties of the member 15 have a dampening effect on any tendency to chatter. The conditioning tool 10 of this invention thus has less tendency to chatter or vibrate when conditioning a pad. This results in superior surface preparation of the pad.

The use of the elastomeric member 15 for the gimble connection permits the performance of the conditioning tool 10 to be adjusted simply by selecting a stiffer or a softer material for the member.

Although, as mentioned above, elastomeric member 15 is an O-ring with a circular cross-section it could well take the form of a ring with a non-circular cross-section. Moreover, if a driving connection is desired between the holder 14 and the body 11 then the portion 17 of the holder and the recess 13 may have complementary non-circular configurations. In that case the elastomeric member 15 would possess a similar configuration.

Figure 4:
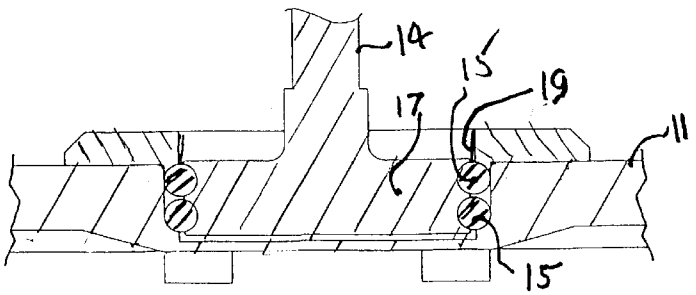
FIG. 4 is a fragmentary sectional view of a modified conditioning tool.

If a stiffer or softer gimble is desired it is possible to equip the tool with two or more members 15 as shown in FIG. 4. The portion 17 of the holder 14 and the retainer 19 are simply configured to accommodate the additional member or members.

What is claimed is:

1. A tool for conditioning a wafer polishing pad, said tool comprising:

a body member having an abrasive peripheral lower surface and an upper surface, said body having a central recess from the upper surface thereof, a holder extending into the recess in said body member, and an elastomeric member in the recess in contact with the holder and the body member, said elastomeric member constituting a gimble connection between the holder and the body member.

2. The tool of claim 1 wherein said elastomeric member is an O-ring having a circular cross-section.

3. The tool of claim 2 wherein said holder has a surface in contact with said O-ring and that surface is shaped to conform to the surface configuration of the cross-section of the O-ring.

4. The tool of claim 3 further comprising a retainer extending from the upper surface of the body into the recess in the body in contact with said O-ring.

5. The tool of claim 2 wherein the body in a lower region of the recess has a surface in contact with said O-ring and that surface is shaped to conform- to the surface configuration of the cross-section of the O-ring.

6. The tool of claim 5 further comprising a retainer extending from the upper surface of the body into the recess in the body in contact with said O-ring.

7. The tool of claim 3 wherein the body in a lower region of the recess has a surface in contact with said O-ring and that surface is shaped to conform to the surface configuration of the cross-section of the O-ring.

8. The tool of claim 7 further comprising a retainer extending from the upper surface of the body into the recess in the body in contact with said O-ring.

9. The tool of claim 8 wherein the portion of the retainer in contact with the O-ring is shaped to conform to the surface configuration of the cross-section of the O-ring.

10. The tool of claim 2 further comprising a retainer extending from the upper surface of the body into the recess in the body in contact with said O-ring.

11. The tool of claim 1 further comprising a retainer extending from the upper surface of the body into the recess in the body iii contact with said elastomeric member.

12. A tool for conditioning a wafer polishing pad, said tool comprising:

a body member having an abrasive peripheral lower surface and an upper surface, said body having a central recess from the upper surface thereof, a holder extending into the recess in said body member, and a pair of elastomeric members in the recess in contact with the holder and they body member, said elastomeric members constituting a gimble connection between the holder and the body member.

13. The tool of claim 12 it wherein said elastomeric members are O-rings having a circular cross-section.

* * * * *